US011820949B2

(12) United States Patent
Koseoglu

(10) Patent No.: US 11,820,949 B2
(45) Date of Patent: Nov. 21, 2023

(54) APPARATUS AND PROCESS FOR THE ENHANCED PRODUCTION OF AROMATIC COMPOUNDS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/149,789

(22) Filed: Jan. 15, 2021

(65) Prior Publication Data

US 2022/0228075 A1 Jul. 21, 2022

(51) Int. Cl.
*C10G 69/10* (2006.01)
*C10G 9/36* (2006.01)
(Continued)

(52) U.S. Cl.
CPC ..... *C10G 69/10* (2013.01); *C10G 9/36* (2013.01); *C10G 35/04* (2013.01); *C10G 45/02* (2013.01);
(Continued)

(58) Field of Classification Search
CPC ..... C10G 69/10; C10G 35/04; C10G 45/02; C10G 9/36; C10G 2300/202; C10G 2300/1055; C10G 2400/30
See application file for complete search history.

(56) References Cited

U.S. PATENT DOCUMENTS 3,074,878 A 1/1963 Pappas
3,111,481 A * 11/1963 Lifland ..... C10G 59/02 208/65
(Continued)

FOREIGN PATENT DOCUMENTS

CN 107177374 B 1/2019
CN 109718760 A 5/2019
(Continued)

OTHER PUBLICATIONS

Office Action dated Jun. 18, 2021 pertaining to U.S. Appl. No. 17/143,296, filed Jan. 7, 2021, 17 pages.
(Continued)

*Primary Examiner* — Michelle Stein
(74) *Attorney, Agent, or Firm* — DINSMORE & SHOHL LLP

(57) ABSTRACT

Embodiments of the present disclosure are directed to a process for the upgrading of petroleum products comprising subjecting a diesel feed to a hydrocracking process, thereby producing a hydrocrackate fraction; subjecting the hydrocrackate fraction to a catalytic reforming process, thereby producing a reformate; and recovering aromatics from the reformate. In accordance with another embodiment of the present disclosure, a method of producing aromatics may comprise introducing a diesel feed to a hydrocracking unit to produce a hydrocrackate fraction, passing the hydrocrackate fraction to a catalytic reforming unit to produce a reformate, and passing the reformate to an aromatic recovery complex to produce an aromatic fraction. In accordance with yet another embodiment of the present disclosure, an apparatus for the upgrading of petroleum products may comprise a hydrocracker, a catalytic reformer, and an aromatic recovery complex. The hydrocracker may be in fluid communication with the catalytic reformer, the catalytic reformer may be in fluid communication with an aromatic recovery complex,
(Continued)

and the hydrocracker may be structurally configured to receive a diesel feed.

18 Claims, 2 Drawing Sheets

(51) Int. Cl.
*C10G 35/04* (2006.01)
*C10G 45/02* (2006.01)

(52) U.S. Cl.
CPC ..... *C10G 2300/1055* (2013.01); *C10G 2300/202* (2013.01); *C10G 2400/30* (2013.01)

(56) References Cited

U.S. PATENT DOCUMENTS 3,132,087 A 5/1964 Kelley et al.
3,159,568 A * 12/1964 Price ..... C10G 69/10 208/89
3,210,264 A * 10/1965 Haney ..... C10G 47/00 208/79
3,240,694 A 3/1966 Mason et al.
3,305,476 A 2/1967 York et al.
3,420,768 A 1/1969 Bray et al.
3,567,602 A * 3/1971 Child ..... C10G 65/12 208/89
3,702,292 A * 11/1972 Burich ..... C10G 9/005 208/80
3,758,403 A 9/1973 Rosinski et al.
3,758,628 A * 9/1973 Strickland ..... C10L 1/06 585/303
3,801,494 A * 4/1974 Moore ..... C10G 65/16 208/62
3,894,931 A 7/1975 Nace et al.
3,894,933 A 7/1975 Owen et al.
3,894,934 A 7/1975 Owen et al.
4,176,053 A 11/1979 Holcombe
4,394,301 A 7/1983 Gardner
4,419,221 A 12/1983 Castagnos, Jr. et al.
4,476,345 A 10/1984 Gray, Jr. et al.
4,695,368 A 9/1987 Ward
4,713,167 A 12/1987 Reno et al.
4,789,457 A 12/1988 Fischer et al.
4,826,587 A 5/1989 Ward et al.
4,828,676 A 5/1989 Sawyer et al.
4,913,799 A 4/1990 Gortsema et al.
4,950,384 A 8/1990 Groeneveld et al.
4,980,053 A 12/1990 Li et al.
5,026,472 A 6/1991 Hoehn et al.
5,147,526 A 9/1992 Kukes et al.
5,326,465 A 7/1994 Yongqing et al.
5,364,514 A 11/1994 Sanborn et al.
5,462,652 A 10/1995 Wegerer
5,863,315 A 1/1999 Jullian et al.
5,885,440 A 3/1999 Hoehn et al.
5,904,835 A 5/1999 Thakkar
6,113,775 A 9/2000 Christolini et al.
6,217,746 B1 4/2001 Thakkar et al.
6,312,586 B1 11/2001 Kalnes et al.
6,478,952 B1 11/2002 Lin
6,656,346 B2 12/2003 Ino et al.
7,271,303 B1 * 9/2007 Sechrist ..... C07C 6/126 208/108
9,464,241 B2 10/2016 Koseoglu et al.
10,053,401 B1 8/2018 Beadle et al.
10,093,873 B2 10/2018 Koseoglu et al.
2003/0006168 A1 1/2003 Ino et al.
2006/0021912 A1 2/2006 Chen et al.
2007/0272593 A1 11/2007 Stockwell et al.
2009/0159494 A1 * 6/2009 Gautam ..... C10G 47/00 422/600
2009/0283442 A1 * 11/2009 McCall ..... C10G 45/02 208/15
2009/0288985 A1 11/2009 Ong et al.
2012/0016167 A1 1/2012 Hanks
2013/0259764 A1 10/2013 Zimmerman et al.
2013/0291432 A1 * 11/2013 Al-Therwi ..... C10G 35/04 44/447
2014/0171704 A1 6/2014 Erisken et al.
2014/0275673 A1 9/2014 Long et al.
2014/0357913 A1 * 12/2014 Funk ..... C10G 69/04 585/319
2015/0045598 A1 * 2/2015 Funk ..... C10G 61/06 585/253
2015/0141725 A1 * 5/2015 Lippmann ..... C10G 67/00 585/322
2015/0284644 A1 10/2015 Fanget et al.
2018/0066197 A1 * 3/2018 Koseoglu ..... C10G 69/00
2018/0223197 A1 8/2018 Al-Ghamdi et al.
2019/0040328 A1 2/2019 Koseoglu
2019/0203130 A1 * 7/2019 Mukherjee ..... C10G 69/10
2020/0102509 A1 * 4/2020 Bhuwania ..... C10G 55/04
2021/0269724 A1 * 9/2021 Hodgkins ..... C10G 47/30

FOREIGN PATENT DOCUMENTS

CN 110591759 A 12/2019
EP 0512635 b2 11/1992
EP 3536765 A1 9/2019
WO 2020205210 A1 10/2020

OTHER PUBLICATIONS

Office Action dated Jun. 24, 2021 pertaining to U.S. Appl. No. 17/143,286, filed Jan. 7, 2021, 16 pages.
U.S. Office Action dated Nov. 24, 2021 pertaining to U.S. Appl. No. 17/143,296, filed Jan. 7, 2021, 23 pages.
U.S. Office Action dated Dec. 2, 2021 pertaining to U.S. Appl. No. 17/143,286, filed Jan. 7, 2021, 24 pages.
International Search Report and Written Opinion dated Feb. 24, 2022 pertaining to International application No. PCT/US2021/058505 filed Nov. 9, 2021, 14 pages.
International Search Report and Written Opinion dated Sep. 28, 2021 pertaining to International application No. PCT/US2021/020784 filed Mar. 4, 2021, 12 pages.
Notification of Transmittal of the International Search Report and the Written Opinion of the International Searching Authority, or the Declaration dated Apr. 5, 2022 pertaining to International application No. PCT/US2022/011025 filed Jan. 3, 2022, 12 pages.

* cited by examiner

APPARATUS AND PROCESS FOR THE ENHANCED PRODUCTION OF AROMATIC COMPOUNDS

TECHNICAL FIELD

The present disclosure relates to the production of organic compounds and more specifically, to the production of aromatic compounds.

BACKGROUND

Hydrocracking processes are widely used in commercial petroleum refineries to split heavy hydrocarbon molecules into lighter molecules, increasing average volatility and economic value. Additionally, hydrocracking processes may improve the quality of the hydrocarbon feedstock by increasing the hydrogen to carbon ratio and by removing organosulfur and organonitrogen compounds. The significant economic benefit derived from hydrocracking processes has resulted in substantial interest in process improvements.

Catalytic reforming is another significant conversion process in the petrochemical industry. Feeds to a catalytic reforming process often include heavy, low octane straight run naphtha. The reforming process can convert the low octane naphtha into higher octane reformate which is added to gasoline blends. As used herein, "low octane" may refer to a research octane number (RON) of 70 or less and "high octane" may refer to a RON of 90 or more. Aromatic rich reformates are also produced. The aromatic rich reformates comprise benzene, toluene, and xylene (BTX). Conventionally, the catalytic reforming process is only applied to the naphtha feed. Diesel is used as a final fuel product after hydrotreating therefore not hydrocracked.

With the decreasing worldwide demand, there is a surplus of diesel fuel. Therefore, the relative value of diesel fuel to aromatic compounds has been decreasing in recent years. The conventional methods for the simultaneous reforming of naphtha and diesel result in excess production of diesel fuel and insufficient production of valuable aromatic molecules, such as BTX. As the relative demand for these chemicals has changed, the conventional methods and configurations are ill suited to respond to the demands of the modern marketplace.

SUMMARY

Accordingly, new methods and apparatuses are desired to produce enhanced quantities of BTX. Embodiments of the present disclosure meet this need by providing methods and apparatuses which convert diesel to aromatics. Specifically, embodiments meet this need by hydrocracking diesel to produce a hydrocrackate, catalytically reforming the hydrocrackate to produce a reformate, and recovering aromatics from the reformate.

According to the subject matter of the present disclosure, a process for the upgrading of petroleum products may comprise subjecting a diesel feed to a hydrocracking process, thereby producing a hydrocrackate fraction; subjecting the hydrocrackate fraction to a catalytic reforming process, thereby producing a reformate; and recovering aromatics from the reformate.

In accordance with another embodiment of the present disclosure, a method of producing aromatics may comprise introducing a diesel feed to a hydrocracking unit to produce a hydrocrackate fraction, passing the hydrocrackate fraction to a catalytic reforming unit to produce a reformate, and passing the reformate to an aromatic recovery complex to produce an aromatic fraction.

In accordance with yet another embodiment of the present disclosure, an apparatus for the upgrading of petroleum products may comprise a hydrocracker, a catalytic reformer, and an aromatic recovery complex. The hydrocracker may be in fluid communication with the catalytic reformer, the catalytic reformer may be in fluid communication with an aromatic recovery complex, and the hydrocracker may be structurally configured to receive a diesel feed.

Although the concepts of the present disclosure are described herein with primary reference to naphtha and diesel upgrading, it is contemplated that the concepts will enjoy applicability to any upgrading of petroleum products.

BRIEF DESCRIPTION OF THE DRAWINGS

The following detailed description of specific embodiments of the present disclosure can be best understood when read in conjunction with the following drawings.

ABBREVIATIONS

LHSV=liquid hourly space velocity.
Ppmw=parts per million weight.
° C.=degrees Celsius.

$$h^{-1} = \frac{1}{\text{hour}}.$$

BTX=benzene, toluene, and xylene.
BP=boiling point.
IBP=initial boiling point.
FBP=final boiling point.
Wt. %=weight percent.
g/cc=grams per cubic centimeter.
Kg=kilograms.
Psi=pounds per square inch gauge pressure.
SLt/Lt=standard liters of hydrogen gas per liter of hydrocarbon at standard conditions. Standard conditions are 15° C. and 1 atm pressure.

DETAILED DESCRIPTION

The production of increased quantities of aromatics from a given quantity of petrochemical feed is of great interest considering current trends in demand. Traditional processes for refining petrochemical feeds were designed to satisfy other parameters. Accordingly, processes and apparatuses which can satisfy the demand for increased production of aromatics are desirable.

Figure 1:
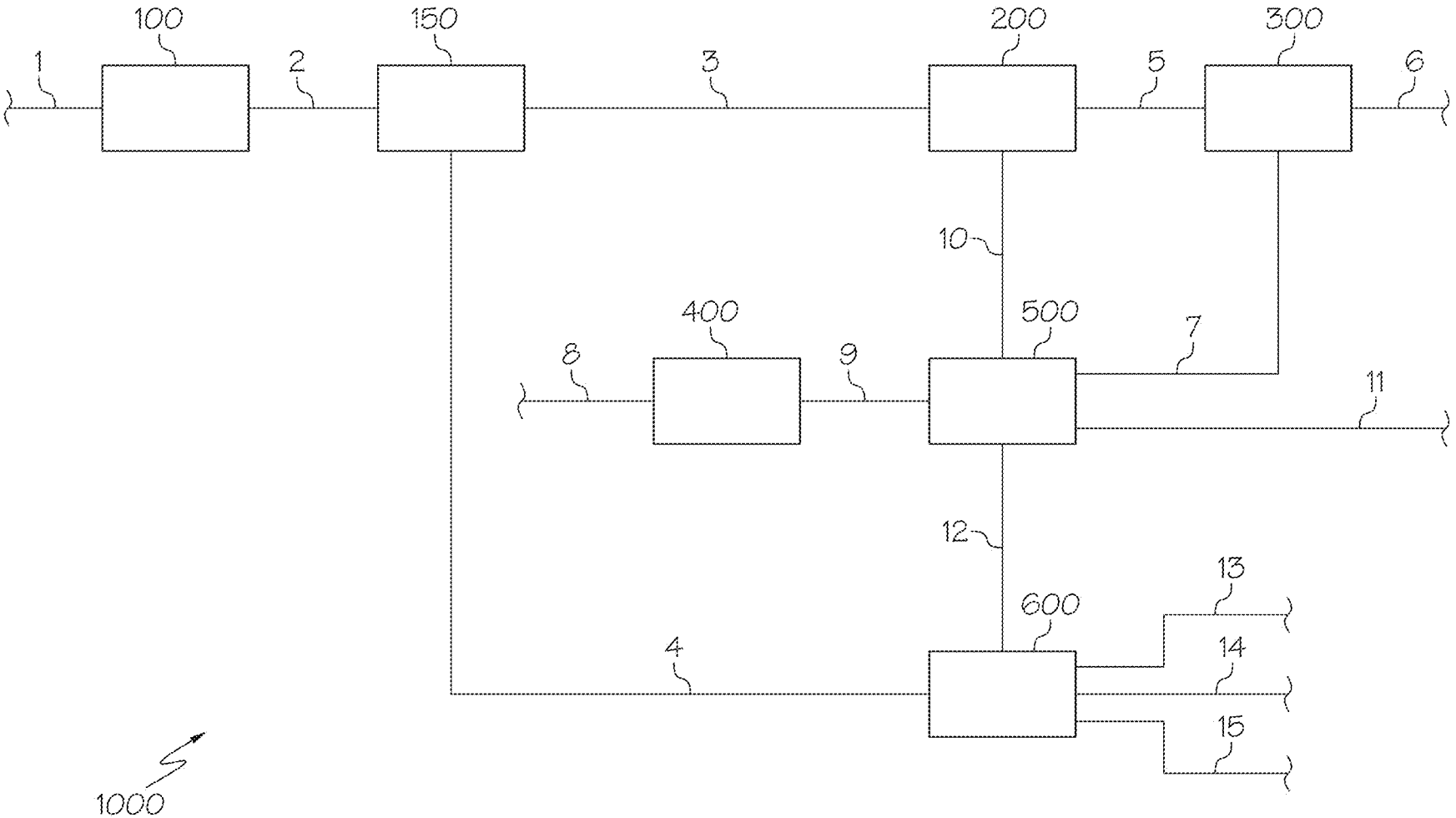
FIG. 1 is a process flow diagram of the apparatus and process of the present disclosure.

As is shown in FIG. 1, embodiments of the present disclosure meet this demand by hydrocracking a diesel feed 8 to form a hydrocrackate fraction 10, catalytically reforming the hydrocrackate 10 to form a reformate 5, and recovering aromatics from the reformate 5.

The subject matter of the present disclosure is directed to a process for the upgrading of petroleum products. As is shown in FIG. 1, the process 1000 may comprise subjecting a diesel feed 8 to a hydrocracking process, thereby producing a hydrocrackate fraction 10; subjecting the hydrocrackate fraction 10 to a catalytic reforming process, thereby producing a reformate 5; and recovering aromatics from the reformate 5. The recovered aromatics may comprise a benzene, toluene, xylene (BTX) stream 6 and an aromatics bottoms stream 7.

A method of producing aromatics may comprise introducing a diesel feed 8 to a hydrocracking unit 500 to produce a hydrocrackate fraction 10, passing the hydrocrackate fraction 10 to a catalytic reforming unit 200 to produce a reformate 5, and passing the reformate 5 to an aromatic recovery complex 300 to produce an aromatic fraction. The aromatic fraction may be separated into an aromatic bottoms fraction 7 and a benzene, toluene, xylene (BTX) fraction 6.

Optionally, the diesel feed 8 may be introduced into a hydrodesulphurization apparatus 400 to form a desulphurized diesel stream 9. The desulphurized diesel stream 9 may then be fed to the hydrocracking unit 500.

Still referring to FIG. 1, an apparatus 1000 for the upgrading of petroleum products may comprise a hydrocracker 500, a catalytic reformer 200, and an aromatic recovery complex 300. The hydrocracker 500 may be in fluid communication with the catalytic reformer 200. The catalytic reformer 200 may be in fluid communication with the aromatic recovery complex 300. The hydrocracker 500 may be structurally configured to receive a diesel feed 8.

The process of upgrading petroleum products may include the integrated upgrading of a diesel feed 8 and a naphtha feed 1. The integrated upgrading process may provide significant synergies due to the shared use of equipment.

As used herein, a "diesel feed" may refer to a liquid hydrocarbon with a boiling point between 180° C. and 370° C. The diesel feed may comprise a mixture of hydrocarbons wherein at least 90 wt. % of the hydrocarbon molecules have between 12 and 22 carbon atoms per molecule.

Naphtha may refer to the overhead liquid distillate from the first crude oil distillation unit within a refinery. Naphtha may have an initial boiling point (IBP) of greater than 20° C. and a final boiling point (FBP) of less than 205° C. For example, naphtha may have a IBP of greater than 30° C., greater than 32° C., greater than 36° C., greater than 40° C., greater than 50° C., greater than 60° C., or any subset thereof. Naphtha may have a final boiling point of less than 205° C., less than 193° C., less than 190° C., less than 180° C., less than 170° C., less than 160° C., less than 150° C., less than 140° C., less than 130° C., or any subset thereof. According to some specific embodiments, Naphtha may have an initial boiling point of greater than 20° C. and a final boiling point of less than 180° C. As used herein, the "initial boiling point" refers to the temperature of a liquid at which its vapor pressure is equal to the standard pressure (101.3 kPa), i.e., the first gas bubble appears. As used herein, the "final boiling point" refers to the maximum temperature observed on the distillation thermometer when a standard ASTM distillation is carried out.

According to some embodiments, naphtha may have a boiling point from 20° C. to 205° C., from 20° C. to 193° C., from 20° C. to 190° C., from 20° C. to 180° C., from 20° C. to 170° C., from 32° C. to 205° C., from 32° C. to 193° C., from 32° C. to 190° C., from 32° C. to 180° C., from 32° C. to 170° C., from 36° C. to 205° C., from 36° C. to 193° C., from 36° C. to 190° C., from 36° C. to 180° C., from 36° C. to 170° C., or any subset thereof.

A hydrocracker 500 may be any reactor structurally configured for sustaining a hydrocracking process. A hydrocracking process may refer to a process comprising exposing a hydrocarbon feed to a hydrocracking catalyst, at a hydrocracking pressure, at a hydrocracking temperature, and in the presence of hydrogen. The hydrogen may be combined with the hydrocarbon feed before the feeds enter the hydrocracker 600 or the hydrogen may enter the hydrocracker 500 separately from the hydrocarbon feed.

At least 1 standard liter of hydrogen gas per liter of hydrocarbon at standard conditions (SLt/Lt) may be present in the hydrocracker 500 during the hydrocracking process. For example, hydrogen may be present in an amount from 1 SLt to 2500 SLt, from 1 SLt/Lt to 2000 SLt/Lt, from 1 SLt/Lt to 1500 SLt/Lt, from 800 SLt/Lt to 2500 SLt/Lt, from 800 SLt/Lt to 2000 SLt/Lt, from 800 SLt/Lt to 1500 SLt/Lt, from 1000 SLt/Lt to 2500 SLt/Lt, from 1000 SLt/Lt to 2000 SLt/Lt, from 1000 SLt/Lt to 1500 SLt/Lt, or any subset thereof.

The hydrocracking catalyst may comprise amorphous oxides, crystalline zeolites and binder, or both. The amorphous oxides may comprise one or more of silica, alumina, and titania. The zeolite may comprise zeolite-beta, zeolite-Y, Beta, ZSM-5, ZSM-11, or any other zeolite. The hydrocracking catalyst may further comprise an active metal, such as a noble metal selected from IUAPC groups 9 and 10, a non-noble metal sulphide selected from IUPAC group 6, a non-noble metal selected from IUPAC groups 9 and 10, or a combination thereof. For example the noble metal may comprise platinum, palladium, rhodium, ruthenium, or a combination thereof. The non-noble metal sulphide may comprise molybdenum, tungsten, or both. The non-noble metal may comprise cobalt, nickel, or both.

The hydrocracking temperature may be from 300° C. to 450° C. For example, the hydrocracking temperature may be from 300° C. to 420° C., from 300° C. to 400° C., from 300° C. to 380° C., from 320° C. to 450° C., from 320° C. to 420° C., from 320° C. to 400° C., from 340° C. to 450° C., from 340° C. to 420° C., from 340° C. to 400° C., from 340° C. to 380° C., from 360° C. to 450° C., from 360° C. to 420° C., from 360° C. to 400° C., from 360° C. to 380° C., from 380° C. to 450° C., from 380° C. to 420° C., from 380° C. to 400° C., or any subset thereof.

The hydrocracking pressure may be from 50 bar to 150 bar. For example, the hydrocracking pressure may be from 50 bar to 125 bar, from 50 bar to 100 bar, from 75 bar to 150 bar, from 75 bar to 125 bar, from 100 bar to 150 bar, or any subset thereof.

A desulfurized naphtha feed 2 may be separated into a light naphtha stream 4 and a heavy naphtha stream 3. The heavy naphtha stream 3 may have a higher average number of carbons per molecule than the light naphtha stream 4. At least 90 wt. % of the light naphtha stream 4 may comprise hydrocarbon molecules with from 5 to 6 carbon atoms per molecule. At least 90 wt. % of the heavy naphtha stream may comprise hydrocarbon molecules with from 7 to 11 carbon atoms per molecule.

The desulfurized naphtha feed 2 may be separated in a naphtha splitter 150. The naphtha splitter 150 may be in fluid communication with a catalytic reformer 200 and a steam cracker 600.

The naphtha splitter 150 may be structurally configured to split a desulfurized naphtha feed 2 into a light naphtha stream 4 and a heavy naphtha stream 3. Accordingly, the naphtha splitter may be any device configured to split the naphtha stream. For example, the naphtha splitter may comprise a distillation column, a stripper, or a flash column.

The naphtha splitter 150 may be structurally configured to send the light naphtha stream 4 to the steam cracker 600. The naphtha splitter 150 may be structurally configured to send the heavy naphtha stream 3 to the catalytic reformer 200.

The heavy naphtha stream 3 may have a higher average number of carbons per molecule than the light naphtha stream 4.

The desulfurized naphtha feed 2 may be separated into the light naphtha stream 4 and the heavy naphtha stream 3 using extraction, extractive distillation, distillation, solvent extraction, or a combination of these. According to specific embodiments, the desulfurized naphtha feed 2 may be separated into the light naphtha stream 4 and heavy naphtha stream 3 using distillation.

The light naphtha stream 4 may have an initial boiling point of about 20° C. The light naphtha stream 4 may have a final boiling point of less than or equal to 110° C. For example, the light naphtha stream 4 may have a final boiling point of less than or equal to 110° C., 100° C., 90° C., or 88° C. According to some examples, the light naphtha stream 4 may have a boiling point in the range from 20° C. to 110° C., from 20° C. to 100° C., from 20° C. to 90° C., from 20° C. to 88° C., from 20° C. to 68° C., from 32° C. to 110° C., from 32° C. to 100° C., from 32° C. to 90° C., from 32° C. to 88° C., from 32° C. to 68° C., from 36° C. to 110° C., from 36° C. to 100° C., from 36° C. to 90° C., from 36° C. to 88° C., from 36° C. to 68° C., or any subset thereof. At least 90 wt. % of the hydrocarbon molecules in the light naphtha stream 4 may have 6 or fewer carbon atoms. For example, at least 95 wt. %, at least 98 wt. %, or even at least 99 wt. % of the hydrocarbon molecules in the light naphtha stream 4 may have 6 or fewer carbon atoms. In alternate examples, at least 90 wt. %, at least 95 wt. %, at least 98 wt. %, or even at least 99 wt. % of the hydrocarbon molecules in the light naphtha stream may have from 5 to 6 carbon atoms The heavy naphtha stream 3 may have an initial boiling point of greater than 90° C. For example, the initial boiling point of the heavy naphtha stream 3 may be greater than 100° C., or 110° C. The final boiling point of the heavy naphtha stream 3 may be about 205° C. According to some examples, the heavy naphtha stream 3 may have a boiling point in the range from 90° C. to 205° C., from 90° C. to 193° C., from 90° C. to 190° C., from 90° C. to 180° C., from 90° C. to 170° C., from 93° C. to 205° C., from 93° C. to 193° C., from 93° C. to 190° C., from 93° C. to 180° C., from 93° C. to 170° C., from 100° C. to 205° C., from 100° C. to 193° C., from 100° C. to 190° C., from 100° C. to 180° C., from 100° C. to 170° C., from 110° C. to 205° C., from 110° C. to 193° C., from 110° C. to 190° C., from 110° C. to 180° C., from 110° C. to 170° C., or any subset thereof. At least 90 wt. % of the hydrocarbon molecules in the heavy naphtha stream 3 may have more than 6 carbon atoms. For example, at least 95 wt. %, at least 98 wt. %, or even at least 99 wt. % may have from 7 to 11 carbon atoms.

The naphtha feed 1 may be subjected to a hydrodesulphurization process to form a desulphurized naphtha stream 2. Subjecting the naphtha feed 1 to a hydrodesulphurization process may comprise decreasing the concentration of sulfur in the naphtha feed 1 by at least 50%, at least 75%, at least 90%, at least 95%, at least 99%, at least 99.5%, at least 99.9%, or at least 99.99%.

A naphtha hydrodesulphurization apparatus 100 may be in fluid communication with the naphtha splitter 150. The naphtha hydrodesulphurization apparatus 100 may be upstream of the naphtha splitter 150. The naphtha hydrodesulphurization apparatus 100 may comprise any device or combination of devices suitable for sustaining a naphtha hydrodesulphurization process.

Subjecting the naphtha feed 1 to a hydrodesulphurization process may comprise contacting the naphtha feed 1 with a naphtha hydrodesulphurization catalyst, at a naphtha hydrodesulphurization temperature, a naphtha hydrodesulphurization pressure, and in the presence of hydrogen. The naphtha hydrodesulphurization catalyst may comprise cobalt, nickel, molybdenum, alumina, or a combination thereof. The ratio of hydrogen relative to the volume of naphtha feed 1 may be from 1 SLt/Lt to 500 SLt/Lt, from 1 SLt/Lt to 750 SLt/Lt, from 100 SLt/Lt to 200 SLt/Lt, from 100 SLt/Lt to 300 SLt/Lt, from 100 SLt/Lt to 400 SLt/Lt, or any subset thereof.

The naphtha hydrodesulphurization temperature may be from 280° C. to 400° C. For example, the naphtha hydrodesulphurization temperature may be from 290° C. to 390° C., 300° C. to 380° C., from 310° C. to 370° C., 320° C. to 360° C., or any subset thereof.

The naphtha hydrodesulphurization hydrogen partial pressure may be from 10 bar to 50 bar. For example, the naphtha hydrodesulphurization pressure may be from 10 bar to 40 bar, from 10 bar to 30 bar, from 10 bar to 20 bar, from 10 bar to 18 bar, from 10 bar to 16 bar, from 12 bar to 20 bar, from 12 bar to 18 bar, from 14 bar to 20 bar, from 14 bar to 18 bar, from 16 bar to 20 bar, or any subset thereof.

The naphtha feed may be subjected to the hydrodesulphurization process before being separated into the light naphtha stream 4 and heavy naphtha stream 3. Alternatively, the naphtha feed 1 may be separated into light naphtha stream 4 and the heavy naphtha stream 3. The light 4 and heavy 3 naphtha streams may then be subjected to the hydrodesulphurization process.

One or both of an aromatic bottoms stream 7 and a diesel feed 8 may be hydrocracked to produce a hydrocrackate fraction 10. The hydrocrackate fraction 10 may refer to a petroleum product which has been subjected to a hydrocracking process.

The hydrocrackate fraction 10 may comprise at least 50 wt. % of the combination of paraffins and naphthenes. For example, the hydrocrackate fraction 10 may comprise at least 60 wt. %, at least 70 wt. %, at least 80 wt. %, or at least 90 wt. % of the combination of paraffins and naphthenes.

The hydrocrackate fraction 10 may comprise less than 20 wt. % of aromatic compounds. For example, the hydrocrackate fraction 10 may comprise less than 15 wt. %, less than 10 wt. %, less than 5 wt. %, or even less than 1 wt. % of aromatic compounds.

The feed to the hydrocracking process may comprise a diesel feed 8, an aromatic bottoms stream 7, or both. The aromatic bottoms stream 7 may be subjected to the hydrocracking process in conjunction with the diesel feed 8. The aromatic bottoms stream 7 may be hydrocracked at the same time and place as the diesel feed 8. This may be accomplished by injecting the aromatic bottoms stream 7 and the diesel feed 8 into different parts of the same reactor, at the same time. Alternatively, the aromatic bottoms stream 7 and the diesel feed 8 may be combined before entering the hydrocracker 50.

A catalytic reforming process may comprise contacting a hydrocarbon liquid with a reforming catalyst, at a reforming temperature. The hydrocarbon liquid may comprise the hydrocrackate fraction 10, the heavy naphtha stream 3, or both.

The catalytic reforming process may take place in a catalytic reformer 200. A catalytic reformer 200 may be any reactor structurally configured to hold the reforming catalyst and to sustain a catalytic reforming process. For example, a catalytic reformer may be a fixed-bed reactor, a moving bed reactor, or a fluidized bed reactor. A fixed-bed reactor may refer to a reactor in which the catalyst does not move during the catalytic reaction. A moving-bed reactor may refer to a reactor in which the catalyst is constantly flowing through the reactor along with the reactants. A fluidized-bed reactor may refer to a reactor in which the catalyst is suspended in the reactant gas.

The catalytic reforming process may be a commercial catalytic reforming process. The commercial processes differ at least in part in the manner in which they regenerate the reforming catalyst to remove the coke formed in the reactors. The regeneration process may be characterized as semi-regenerative, cyclic regeneration, or continuous catalyst regeneration (CCR). In a semi-regenerative process, the entire unit, including all reactors in the series, is shut-down for catalyst regeneration in all reactors. Cyclic configurations utilize an additional "swing" reactor to permit one reactor at a time to be taken off-line for regeneration while the others remain in service. It is understood that cyclic reformers run under more severe operating conditions than semi-regenerative configurations, for improved octane number and yields. Continuous catalyst regeneration configurations, such as CCR Platforming (developed by Universal Oil Products) and Octanizing (developed by Axens, a subsidiary of Institut Francais du Petrole), provide for essentially uninterrupted operation by catalyst removal, regeneration and replacement. In these reformers, the catalyst is in a moving bed and regenerated frequently. Relative to other methods, continuous regeneration configurations are believed to allow operation at much lower pressure and result in higher octane products, the production of additional $C_{5+}$, and elevated hydrogen yield. Other commercially available catalytic reforming processes include Rheniforming® (developed by Chevron) and Powerforming (developed by Exxonmobil).

According to some embodiments, the heavy naphtha stream 3 may be subjected to the catalytic reforming process in conjunction with the hydrocrackate fraction 10. The heavy naphtha stream 3 may enter the catalytic reformer 200 at a separate location from the hydrocrackate fraction 10. Alternatively, the heavy naphtha stream 3 may be combined with the hydrocrackate fraction 10 before the streams enter the catalytic reformer 200. When the heavy naphtha stream 3 is subjected to the catalytic reforming process in conjunction with the hydrocrackate fraction 10, the streams may have a combined output. It is believed that by catalytically reforming the hydrocrackate fraction with the heavy naphtha stream, a single catalytic reformer may produce more aromatics than would otherwise be possible.

The reforming catalyst may comprise one or more reforming active metals on a reforming catalyst support. The reforming catalyst support may comprise one or more of silica, alumina, and silica-alumina or zeolite. The reforming active metals may comprise one or more noble metals, such as, platinum and rhenium. The reforming active metals may further comprise bi-metallic or tri-metallic catalysts with additional non-noble metals.

The reforming catalyst may comprise mono-functional or bi-functional catalyst. The reforming catalysts may contain one or more metals or metal compounds (such as metal oxides or metal sulfides) where the metals are selected from the Periodic Table of the Elements IUPAC Groups 8-10. As used herein, a "bi-functional catalyst" has both metal sites and acidic sites. According to some embodiments, the metal may include one or more of Pt, Re, Au, Pd, Ge, Ni, Ag, Sn, or Ir. The metal may include a metal halide. The metal is typically deposited on or otherwise incorporated in a support. The support may include amorphous alumina, amorphous silica-alumina, zeolites, or combinations thereof. In certain embodiments, the reforming catalysts may include IUPAC Group 8-10 metals of which are supported on alumina, silica, or silica-alumina.

The reforming catalyst may be chlorinated prior to the catalytic reforming process. Chloriding may refer to exposing the reforming catalyst to one or both of elemental chlorine or a compound which may break down to form elemental chlorine, such as perchloroethylene.

The reforming temperature may be from 260° C. to 560° C. For example, the reforming temperature may be from 40° C. to 560° C., 450° C. to 560° C., 450° C. to 540° C., or any subset thereof.

The hydrocarbon liquid may contact the reforming catalyst in the presence of hydrogen. For example, the hydrogen may be present in the catalytic reforming process at a hydrogen partial pressure of from 1 bar to 50 bar, 1 bar to 20 bar, 1 bar to 10 bar, 4 bar to 50 bar, 4 bar to 20 bar, 4 bar to 10 bar, or any subset thereof.

The hydrocarbon liquid may contact the reforming catalyst at a liquid hourly space velocity (LHSV) of from 0.5 $h^{-1}$ to 10 $h^{-1}$. For example, the hydrocarbon liquid may contact the reforming catalyst at a LHSV of from 0.5 $h^{-1}$ to 7 $h^{-1}$, from 0.5 $h^{-1}$ to 4 $h^{-1}$, from 0.5 $h^{-1}$ to 2 $h^{-1}$, from 1 $h^{-1}$ to 10 $h^{-1}$, from 1 $h^{-1}$ to 7 $h^{-1}$, from 1 $h^{-1}$ to 4 $h^{-1}$, from 1 $h^{-1}$ to 2 $h^{-1}$, from 2 $h^{-1}$ to 4 $h^{-1}$ to 10 $h^{-1}$, from 6 $h^{-1}$ to 10 $h^{-1}$, from 8 $h^{-1}$ to 10 $h^{-1}$, or any subset thereof. LHSV is calculated as the mass flow rate of the hydrocarbon liquid divided by the mass of catalyst.

A reformate 5 may refer to the hydrocarbon liquid which exits the catalytic reformer 200. The reformate 5 may comprise at least 60 wt. % aromatic compounds. For example, the reformate may comprise at least 65 wt. %, at least 70 wt. %, at least 75 wt. %, at least 80 wt. %, at least 85 wt. %, or at least 90 wt. %, of aromatic compounds.

The reformate 5 may comprise at least 30 wt. % of the combined weight of benzene, toluene, and xylenes (BTX). For example, the reformate 5 may comprise at least 40 wt. %, at least 50 wt. %, at least 60 wt. %, or at least 70 wt. % of BTX.

The reformate 5 may comprise at least 3 wt. % benzene. For example, the reformate 5 may comprise at least 3.5 wt. % or at least 4 wt. % benzene. According to some embodiments, the reformate may comprise from 3 wt. % to 10 wt. % benzene. For example, the reformate 5 may comprise from 3 wt. % to 8 wt. %, from 3 wt. % to 6 wt. %, from 4 wt. % to 10 wt. %, from 4 wt. % to 8 wt. %, from 4 wt. % to 6 wt. %, or any subset thereof, of benzene.

The reformate 5 may comprise at least 5 wt. % toluene. For example, the reformate 5 may comprise at least 10 wt. %, at least 15 wt. %, at least 20 wt. %, or at least 22 wt. % of toluene. According to some embodiments, the reformate 5 may comprise from 10 wt. % to 40 wt. % toluene. For example, the reformate 5 may comprise from 10 wt. % to 35 wt. %, from 10 wt. % to 30 wt. %, from 15 wt. % to 40 wt. %, from 15 wt. % to 35 wt. %, from 15 wt. % to 30 wt. %, from 20 wt. % to 40 wt. %, from 20 wt. % to 30 wt. %, or any subset thereof, of toluene.

The reformate 5 may comprise at least 5 wt. % xylenes. For example, the reformate 5 may comprise at least 10 wt. %, at least 15 wt. %, at least 20 wt. %, or at least 25 wt. % of xylenes. According to some embodiments, the reformate 5 may comprise from 5 wt. % to 45 wt. % of xylenes. For example, the reformate 5 may comprise from 5 wt. % to 40 wt. %, from 5 wt. % to 30 wt. %, from 10 wt. % to 45 wt. %, from 10 wt. % to 35 wt. %, from 15 wt. % to 45 wt. %, from 15 wt. % to 35 wt. %, from 20 wt. % to 40 wt. %, from 25 wt. % to 35 wt. %, from 20 wt. % to 35 wt. %, from 25 wt. % to 40 wt. %, or any subset thereof, of xylenes.

The reformate 5 may comprise less than 40 wt. % of paraffins, olefins and naphthenes. According to some embodiments, the reformate 5 may comprise less than 30 wt. %, less than 25 wt. %, less than 20 wt. %, or less than 15 wt. % of paraffins, olefins and naphthenes.

Aromatics may be recovered from the reformate 5 in an aromatic recovery complex 300. An aromatic recovery complex 300 may comprise any combination of unit operations configured for the separation and recovery of aromatic compounds. The unit operations may include extraction, extractive distillation, adsorption, crystallization, solvent extraction, selective hydrogenation, deolefinization by alkylation and distillation. Without being limited by theory, it is believed that selective hydrogenation, deolefinization by alkylation, and deolefinization by distillation may be used to remove olefins and diolefins.

The aromatic recovery complex 300 may be in fluid communication with the hydrocracker 500 and the aromatic recovery complex 300 may be structurally configured to send a bottoms stream 7 to the hydrocracker 500.

The aromatic recovery complex 300 may be in fluid communication with the catalytic reformer 200. In such cases, the aromatic recovery complex 300 may be configured to receive a reformate 5 from the catalytic reformer 200 as a feed.

Recovering aromatics may comprise separating the aromatic compounds from other compounds within the reformate 5. Aromatic compounds may be separated from the other compounds within the reformate by extraction, extractive distillation, distillation, solvent extraction, or a combination of these.

Recovering aromatics from the reformate 5 may comprise producing a benzene/toluene/xylene (BTX) stream 6 and an aromatic bottoms stream 7. The BTX stream 6 may comprise at least 80 wt. % benzene, toluene and xylene. For example, the BTX stream may comprise at least 85 wt. %, at least 90 wt. %, at least 95 wt. %, at least 99 wt. %, or any subset thereof, of the combined weight of benzene, toluene and xylene.

The aromatics bottoms stream 7 may comprise at least 40 wt. % of aromatic molecules. For example, the aromatic bottoms stream 7 may comprise at least 50 wt. %, at least 60 wt. %, at least 70 wt. %, at least 80 wt. %, at least 90 wt. %, at least 92 wt. %, at least 94 wt. %, at least 96 wt. %, or even great than 98 wt. % of aromatic molecules.

The aromatic bottoms stream 7 may comprise at least 70 wt. % of $C_{9+}$ molecules. For example, the aromatic bottoms stream 7 may comprise at least 75 wt. %, at least 80 wt. %, at least 85 wt. %, at least 90 wt. %, at least 95 wt. %, at least 99 wt. % of $C_{9+}$ molecules. As used herein, $C_{9+}$ molecules may refer to any molecules with at least nine carbon atoms.

The aromatic bottoms stream 7 may comprise at least 70 wt. % of molecules which are aromatic. "Aromatic" compounds should be understood to include compounds which are mono-aromatic, di-aromatic, tri-aromatic, or tetra-aromatic. Aromatic compounds may have alkyl groups attached. The attached alkyl groups may have carbon numbers ranging from 1 to 10. Di, tri, and tetra aromatics may be condensed aromatics, in which all of the rings are connected to each other or alkyl bridged di, tri, tetra aromatics non-condensed aromatics.

A mass flow rate of the BTX stream 6 may be at least 70% of a mass flow rate of the naphtha feed 1. For example, the mass flow rate of the BTX stream 6 may be at least 75%, at least 80%, at least 85%, at least 90%, or even at least 95% of a mass flow rate of the naphtha feed 1. Keeping the mass flow rate of the BTX stream 6 as high as possible relative to the naphtha feed 1 may be beneficial by maximizing the economic value of the products relative to the cost of the inputs.

The diesel feed 8 may be subjected to a hydrodesulphurization process prior to the hydrocracking process. Subjecting the diesel feed to a hydrodesulphurization process may comprise decreasing the concentration of sulfur in the diesel feed 1 by at least 50%, 75%, 90%, 95%, 99.9%, or any subset thereof.

The diesel feed 8 may be subjected to the hydrodesulphurization process in a diesel hydrodesulphurization apparatus 400. The diesel hydrodesulphurization apparatus 400 may comprise any reactor structurally configured to carry out the diesel hydrodesulphurization process.

The diesel hydrodesulphurization apparatus 400 may be in fluid communication with the hydrocracker 500. For example, the diesel hydrodesulphurization apparatus 400 may be upstream of the hydrocracker 500.

Subjecting the diesel feed 8 to a hydrodesulphurization process may comprise contacting the diesel feed 8 with a diesel hydrodesulphurization catalyst, at a diesel hydrodesulphurization temperature, a diesel hydrodesulphurization hydrogen partial pressure, and a hydrodesulphurization LHSV. The diesel hydrodesulphurization catalyst may comprise cobalt, nickel, molybdenum, alumina, or a combination thereof.

The hydrogen gas feed rate relative to the volume of diesel feed 1 in the hydrodesulphurization process 100 may be less than 1000 SLt/Lt. For example, the hydrogen gas feed rate relative to the volume of diesel feed 1 in the hydrodesulphurization process 100 may be less than 700 SLt/Lt, less 500 SLt/Lt, from 200 SLt/Lt to 1000 SLt/Lt, from 200 SLt/Lt to 700 SLt/Lt, from 200 SLt/Lt to 500 SLt/Lt, from 250 SLt/Lt to 700 SLt/Lt, from 250 SLt/Lt to 500 SLt/Lt, from 300 SLt/Lt to 1000 SLt/Lt, from 300 SLt/Lt to 700 SLt/Lt, from 300 SLt/Lt to 500 SLt/Lt, or any subset thereof.

The diesel hydrodesulphurization temperature may be from 270° C. to 450° C. For example, the diesel hydrodesulphurization temperature may be from 300° C. to 450° C., from 320° C. to 450° C., from 340° C. to 450° C., from 270° C. to 435° C., from 300° C. to 435° C., from 320° C. to 435° C., from 340° C. to 435° C., from 270° C. to 400° C., from 300° C. to 400° C., from 320° C. to 400° C., from 340° C. to 400° C., from 270° C. to 380° C., from 300° C. to 380° C., from 320° C. to 380° C., from 340° C. to 360° C., from 270° C. to 360° C., from 300° C. to 360° C., from 320° C. to 360° C., or from 340° C. to 360° C.

The diesel hydrodesulphurization hydrogen partial pressure may be from 30 bar to 80 bar. For example, the diesel hydrodesulphurization hydrogen partial pressure may be from 30 bar to 70 bar, from 30 bar to 60 bar, from 35 bar to 80 bar, from 35 bar to 70 bar, from 35 bar to 60 bar, from 40 bar to 80 bar, from 40 bar to 70 bar, from 40 bar to 60 bar, or any subset thereof.

The diesel hydrodesulphurization LHSV may be from 0.5 $h^{-1}$ to 2 $h^{-1}$, from 0.5 $h^{-1}$ to 5 $h^{-1}$, from 0.5 $h^{-1}$ to 6 $h^{-1}$, from 0.75 $h^{-1}$ to 2 $h^{-1}$, from 0.75 $h^{-1}$ to 4 $h^{-1}$, from 0.75 $h^{-1}$ to 8 $h^{-1}$, from 1 $h^{-1}$ to 2 $h^{-1}$, from 1 $h^{-1}$ to 4 $h^{-1}$, from 1 $h^{-1}$ to 8 $h^{-1}$, from 0.1 $h^{-1}$ to 10.0 $h^{-1}$, from 0.1 $h^{-1}$ to 6.0 $h^{-1}$, from 0.1 $h^{-1}$ to 5.0 $h^{-1}$, from 0.1 $h^{-1}$ to 4.0 $h^{-1}$, from 0.1 $h^{-1}$ to 2.0 $h^{-1}$, from 0.5 $h^{-1}$ to 10.0 $h^{-1}$, from 0.5 $h^{-1}$ to 5.0 $h^{-1}$, from 0.5 $h^{-1}$ to 2.0 $h^{-1}$, from 0.8 $h^{-1}$ to 10.0 $h^{-1}$, from 0.8 $h^{-1}$ to 6.0 $h^{-1}$, from 0.8 $h^{-1}$ to 5.0 $h^{-1}$, from 0.8 $h^{-1}$ to 4.0 $h^{-1}$, from 0.8 $h^{-1}$ to 2.0 $h^{-1}$, from 1.0 $h^{-1}$ to 10.0 $h^{-1}$, from 1.0 $h^{-1}$ to 6.0 $h^{-1}$, from 1.0 $h^{-1}$ to 5.0 $h^{-1}$, from 1.0 $h^{-1}$ to 4.0 $h^{-1}$, or from 1.0 $h^{-1}$ to 2.0 $h^{-1}$.

Subjecting the diesel feed 8 to the hydrocracking process may comprise producing a light gas ($C_1$-$C_4$) fraction 12. The light gas fraction may be subjected to a steam cracking process. The light gas fraction may be at least 70 wt. % of $C_1$ to $C_4$ molecules. For example, the light gas fraction may be at least 75 wt. %, at least 80 wt. %, at least 85 wt. %, at least 90 wt. %, at least 95 wt. %, or even at least 99 wt. % of $C_1$ to $C_4$ molecules. As used herein, $C_1$ to $C_4$ may refer to hydrocarbons comprising two, three, or four carbon molecules.

Subjecting the diesel feed 8 to the hydrocracking process may comprise producing a light naphtha fraction. The light naphtha fraction may be at least 70 wt. % of $C_5$ to $C_6$ molecules. For example, the light naphtha fraction may be at least 75 wt. %, at least 80 wt. %, at least 85 wt. %, at least 90 wt. %, at least 95 wt. %, or even at least 99 wt. % of $C_5$ to $C_6$ molecules.

According to embodiments where subjecting the diesel feed 8 to the hydrocracking process produces both a light gasfraction and a light naphtha fraction, the mass ratio of light gas fraction:light naphtha fraction may be from 1:10 to 100:10. For example, the mass ratio of light gas fraction: light naphtha fraction may be from 2:10 to 100:10, from 4:10 to 100:10, from 8:10 to 100:10, from 10:10 to 100:10, from 10:10:80:10, from 10:10 to 60:10, from 10:10 to 40:10, from 10:10 to 20:10, from 1:10 to 90:10, from 2:10 to 80:10, from 4:10 to 60:10, from 6:10 to 80:10, from 8:10 to 20:10, from 9:10 to 11:10, or any subset thereof.

The steam cracker 600 may be in fluid communication with the hydrocracker 500. The steam cracker 600 may be configured to receive a light gas fraction 12 from the hydrocracker 500 as a feed. The steam cracker 600 may further be in fluid communication with the naphtha splitter 150 and configured to receive the light naphtha stream 4 as a feed.

According to some embodiments, the light naphtha stream 4 may be subjected to the steam cracking process in conjunction with the light gas fraction 12. The light naphtha stream 4 may enter the steam cracker 600 at a separate location from the light gas fraction 12. Alternatively, the light naphtha stream 4 may be combined with the light gas fraction 12 before the streams enter the steam cracker 600. When the light naphtha stream 4 is subjected to the steam cracking process in conjunction with the light gas fraction 12, the streams may have a combined output.

Subjecting the light gas fraction to a steam cracking process may comprise contacting the light gas with a steam, at a steam cracking temperature and a steam partial pressure.

The steam partial pressure may be at least 0.5 bar. For example, the steam partial pressure may be at least 1 bar, at least 2 bar, from 0.5 bar to 5 bar, from 0.5 bar to 2 bar, from 0.5 bar to 1.5 bar, from 0.5 bar to 1 bar, from 1 bar to 5 bar, from 1 bar to 2 bar, from 1 bar to 1.5 bar, or any subset thereof.

The steam cracking temperature may be at least 600° C. For example, the steam cracking temperature may be at least 650° C., at least 700° C., at least 750° C., at least 800° C., at least 850° C., at least 900° C., from 650° C. to 1200° C., from 700° C. to 1200° C., from 750° C. to 1200° C., from 800° C. to 1200° C., from 650° C. to 1100° C., from 650° C. to 1000° C., from 650° C. to 900° C., from 750° C. to 1200° C., from 750° C. to 1100° C., from 750° C. to 1000° C., or any subset thereof.

Subjecting the diesel feed 8 to the hydrocracking process may comprise producing a fuel fraction 11. The fuel fraction may comprise a light fuel fraction and a heavy fuel fraction. The light fuel fraction may include $C_1$ compounds up to compounds which boil at a temperature of 180° C. The heavy fuel fraction may include compounds which boil at temperatures greater than 180° C. According to some embodiments, the heavy fuel fraction may be recycled back to the hydrodesulphurization unit 100 or the hydrocracking unit 500.

A mass flow rate of the fuel fraction 11 may be less than 20 wt. % of a mass flow rate of the diesel feed 8. For example, the mass flow rate of the fuel fraction 11 may be less than 17.5 wt. %, less than 15 wt. %, less than 12.5 wt. %, less than 10 wt. %, less than 8 wt. %, less than 6 wt. %, less than 4 wt. %, less than 2 wt. %, less than 1 wt. %, less than 0.5 wt. %, or even less than 0.2 wt. % of the mass flow rate of the diesel feed 8.

According to an aspect, either alone or in combination with any other aspect, a process for the upgrading of petroleum products comprises: subjecting a diesel feed to a hydrocracking process, thereby producing a hydrocrackate fraction; subjecting the hydrocrackate fraction to a catalytic reforming process, thereby producing a reformate; and recovering aromatics from the reformate.

According to a second aspect, either alone or in combination with any other aspect, the diesel feed is subjected to a hydrodesulphurization process prior to the hydrocracking process.

According to a third aspect, either alone or in combination with any other aspect, the hydrocrackate fraction has a boiling point of less than or equal to 180° C.

According to a fourth aspect, either alone or in combination with any other aspect, recovering aromatics from the reformate comprises producing a benzene/toluene/xylene (BTX) stream and an aromatic bottoms stream.

According to a fifth aspect, either alone or in combination with any other aspect, the aromatic bottoms stream is subjected to the hydrocracking process in conjunction with the diesel feed.

According to a sixth aspect, either alone or in combination with any other aspect, subjecting the diesel feed to the hydrocracking process further comprises producing a light gas fraction and the light gas fraction is subjected to a steam cracking process.

According to a seventh aspect, either alone or in combination with any other aspect, subjecting the diesel feed to the hydrocracking process further comprises producing a fuel fraction and a mass flow rate of the fuel fraction is less than 10 wt. % of a mass flow rate of the diesel feed.

According to an eighth aspect, either alone or in combination with any other aspect, a naphtha feed is separated into a light naphtha stream and a heavy naphtha stream, and the heavy naphtha stream has a higher average number of carbons per molecule than the light naphtha stream.

According to a ninth aspect, either alone or in combination with any other aspect, the naphtha feed is subjected to a hydrodesulphurization process.

According to a tenth aspect, either alone or in combination with any other aspect, the heavy naphtha stream is subjected to the catalytic reforming process in conjunction with the hydrocrackate fraction.

According to an eleventh aspect, either alone or in combination with any other aspect, hydrocracking the diesel feed further comprises producing a light gas fraction, the light gas fraction is subjected to a steam cracking process, and the light naphtha stream is subjected to a steam cracking process in conjunction with the light gas fraction.

According to a twelfth aspect, either alone or in combination with any other aspect, recovering aromatics from the reformate comprises producing a BTX stream and an aromatic bottoms stream, and a mass flow rate of the BTX stream is at least 70% of a mass flow rate of the naphtha feed.

According to a thirteenth aspect, either alone or in combination with any other aspect, a method of producing aromatics comprises: introducing a diesel feed to a hydrocracking unit to produce a hydrocrackate fraction, passing the hydrocrackate fraction to a catalytic reforming unit to produce a reformate, and passing the reformate to an aromatic recovery complex to produce an aromatic fraction.

According to a fourteenth aspect, either alone or in combination with any other aspect, an apparatus for the upgrading of petroleum products comprises a hydrocracker, a catalytic reformer, and an aromatic recovery complex, wherein: the hydrocracker is in fluid communication with the catalytic reformer, the catalytic reformer is in fluid communication with an aromatic recovery complex, and the hydrocracker is structurally configured to receive a diesel feed.

According to a fifteenth aspect, either alone or in combination with any other aspect, the apparatus further comprises a diesel hydrodesulphurization apparatus in fluid communication with the hydrocracker.

According to a sixteenth aspect, either alone or in combination with any other aspect, the apparatus further comprises a naphtha splitter in fluid communication with the catalytic reformer and a steam cracker, wherein: the steam cracker is in fluid communication with the hydrocracker, the naphtha splitter is structurally configured to split a naphtha feed into a light naphtha stream and a heavy naphtha stream, the naphtha splitter is structurally configured to send the light naphtha stream to the steam cracker, the naphtha splitter is structurally configured to send the heavy naphtha stream to the catalytic reformer, and the heavy naphtha stream has a higher average number of carbons per molecule than the light naphtha stream.

According to a seventeenth aspect, either alone or in combination with any other aspect, the aromatic recovery complex is in fluid communication with the hydrocracker and the aromatic recovery complex is structurally configured to send a bottoms stream to the hydrocracker.

According to an eighteenth aspect, either alone or in combination with any other aspect, the apparatus further comprises a naphtha hydrodesulphurization apparatus in fluid communication with the naphtha splitter.

EXAMPLES

Example 1—Naphtha Hydrodesulphurization

A straight run naphtha produced from Arabian heavy crude oil having a specific gravity of 0.76418 and comprising 184 parts per million weight (ppmw) of sulfur was desulfurized over a hydrodesulphurization catalyst at a temperature of 300° C., hydrogen partial pressure of 20 bar, hydrogen to hydrocarbon molar ratio of 100, and a liquid hourly space velocity (LHSV) of 9.5 $h^{-1}$. The hydrodesulphurization catalyst comprised Co—Mo on alumina γ-alumina support. The sulfur level was reduced to less than 0.5 ppmw with almost full recovery of liquid volume (99.9 volume percent).

Example 2—Diesel Hydrodesulphurization

A straight run diesel from Arabian heavy crude oil was desulfurized over a conventional hydrodesulphurization catalyst at a temperature of 355° C., a hydrogen partial pressure of 33 bar, hydrogen to hydrocarbon molar ratio of 355, and a LHSV of 1.5 $h^{-1}$. The hydrodesulphurization catalyst comprised Co—Ni—Mo on an alumina support. Table 1 summarizes composition of the straight run diesel. Table 3 summarizes the composition of the desulphurized diesel. As is shown in Table 3, the sulfur level was reduced to 9 ppmw.

TABLE 1

| Component | wt. % |
|---|---|
| $H_2S$ | 1.24 |
| $NH_3$ | 0.00 |
| $C_1$ | 0.03 |
| $C_2$ | 0.03 |
| $C_3$ | 0.10 |
| $C_4$ | 0.13 |
| Naphtha (BP less than 177° C.) | 7.71 |
| Diesel (BP from 177° C. to 370° C.) | 88.18 |
| Residue (BP greater than 370° C.) | 2.86 |
| Total | 100.28 |

Example 3—Catalytic Reforming

The desulfurized heavy naphtha stream from Example 1 was processed over a conventional Pt/Pd on alumina catalytic reforming catalyst at 540° C., 8 bar, a hydrogen to hydrocarbon molar ratio of 7, and a LHSV of 1 $h^{-1}$. Table 2 summarizes the yield and composition of the reformate produced.

TABLE 2

| Property/Composition | Unit | Value |
|---|---|---|
| Research Octane Number | | 109 |
| n-Paraffins | wt. % | 1.99 |
| iso-Paraffins | wt. % | 4.67 |
| Olefins | wt. % | 0.00 |
| Naphthenes | wt. % | 0.36 |
| Aromatics | wt. % | 92.99 |
| Specific Gravity | g/cc | 0.8519 |
| Yields | | 100.01 |
| $C_1 + C_2$ | wt. % | 2.80 |
| $C_3 + C_4$ | wt. % | 5.70 |
| $C_{5+}$ | wt. % | 85.70 |
| Hydrogen | wt. % | 5.10 |

As is shown in Table 2, the reformate has a research octane number of 109 and contains 93.0 wt. % of aromatics. The specific breakdown of the aromatics is 4.3 wt. % benzene, 24.5 wt. % toluene, and 30.0 wt. % xylenes where the weight percentage is calculated on the basis of the weight of the entire mixture.

Example 4—Diesel Hydrocracking

A hydrocracking pilot plant test was conducted using the hydro desulfurized diesel oil from Example 2 as a feedstock. The properties of the feedstock are shown in Table 3. The experiments were conducted at 60 bar of hydrogen partial pressure, a temperature of 355° C., a LHSV of 1 $h^{-1}$, and hydrogen to gas oil ratio of 1,000 SLt/Lt. The catalyst was platinum supported on a USY-zeolite.

TABLE 3

| Property | Unit | Value |
|---|---|---|
| Density @ 15.6° C. | g/cc | 0.83 |
| Sulfur | ppmw | 9 |
| Nitrogen as determined by ASTM D-4629 | ppmw | 21.00 |
| Simulated Distillation as determined by ASTM D-2887 | | |
| 0 wt. % | ° C. | 110 |
| 5 wt. % | ° C. | 177 |
| 10 wt. % | ° C. | 203 |
| 30 wt. % | ° C. | 255 |
| 50 wt. % | ° C. | 287 |
| 70 wt. % | ° C. | 318 |
| 90 wt. % | ° C. | 362 |
| 95 wt. % | ° C. | 379 |
| 100 wt. % | ° C. | 414 |
| 2-Dimensional Gas Chromatography | | |
| Paraffins | wt. % | 52.68 |
| Naphtenes | wt. % | 27.37 |
| Mono-Aromatics | wt. % | 19.45 |
| Di-Aromatics | wt. % | 0.47 |

Feedstock and product distillation data is shown in Table 4. As seen, the diesel is fully converted to gasoline range products.

TABLE 4

Feedstock-Product distillation data

| wt. % | Feedstock Cutoff Temperature | Products Cutoff Temperature |
|---|---|---|
| 0 wt. % | 110° C. | 34° C. |
| 5 wt. % | 177° C. | 59° C. |
| 10 wt. % | 203° C. | 69° C. |
| 30 wt. % | 255° C. | 89° C. |
| 50 wt. % | 287° C. | 103° C. |
| 70 wt. % | 318° C. | 119° C. |
| 90 wt. % | 362° C. | 141° C. |
| 95 wt. % | 379° C. | 149° C. |
| 100 wt. % | 414° C. | 186° C. |

The products were analyzed for compositional type using a paraffins, isoparaffins, olefins, naphthenes, and aromatics (PIONA) analysis and the research octane number was calculated from this data. The PIONA analysis was performed according to ASTM D6730. The PIONA analysis showed 14.3 wt. % of normal paraffins, 52.1 wt. % iso paraffins, 28.8 wt. % of naphthenes, and 3.5 wt. % of aromatics. The calculated research octane number was 66.

Example 5—Steam Cracking

A mixture of liquefied petroleum gas (LPG) (primarily $C_2$ to $C_4$) produced in the diesel hydrocracking step and light naphtha from the naphtha splitter was steam cracked at coil outlet temperature (COT) of 800° C. and a coil outlet pressure (COP) of 1.5 bar. The mass flow rate of hydrocarbons (HC) was fixed in order to achieve an average residence time of 0.7 seconds to 1.0 second. The steam dilution factor was set to $$0.6\frac{\text{Kg} - H_2O}{\text{Kg} - \text{Hyarocarbons}}.$$

The steam cracking yields at a temperature of 800° C. and a pressure of 1.5 bar are given in Table 5 The process yielded 7 wt. % of additional BTX after steam cracking.

TABLE 5

| Component | Yields, wt. % |
|---|---|
| Hydrogen | 2 |
| Methane | 21 |
| Ethylene | 38 |
| Propylene | 17 |
| Butadiene | 4 |
| Other | 5 |
| C5-200* | 11 |
| Fuel | 2 |
| Total | 100.0 |

*C5-200° C. pyrolysis gasoline composition is as follows: Benzene = 4 wt. %, Toluene = 2 wt. %, C8 aromatics = 1 wt. %, and non-aroatics = 2 wt. %.

Comparative Example 6—Overall Material Balance

Figure 2:
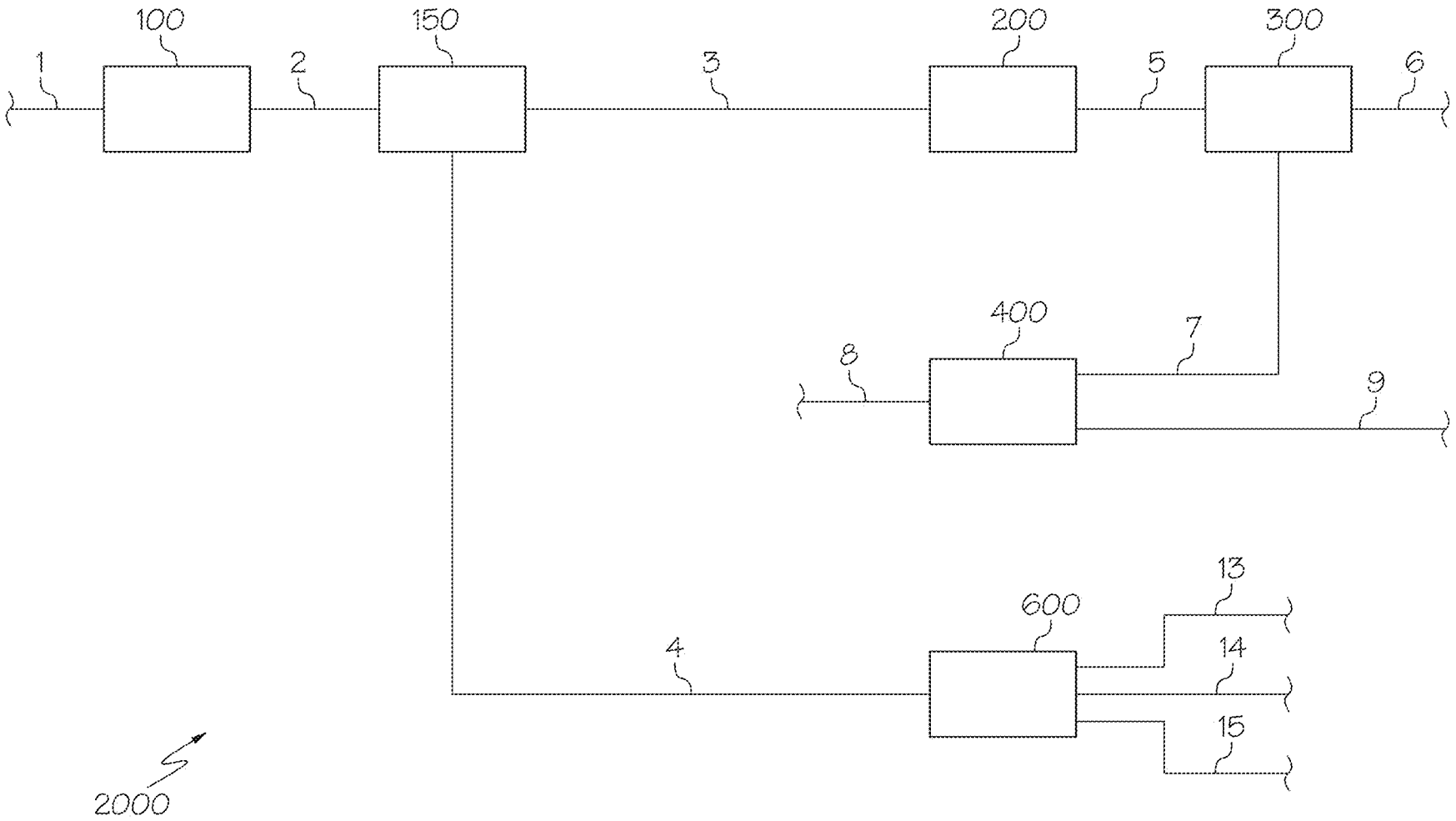
FIG. 2 is a process flow diagram of the apparatus and process of the comparative example.

The comparative example followed the process flow diagram shown in FIG. 2. Results of the material balance are shown in Table 6 and the stream numbers correspond to the numerals in the figure. The operating conditions for each step are given in examples 1 through 5.

TABLE 6

| Stream No. | Stream Name | Kg |
|---|---|---|
| 1 | Full range naphtha | 1,200 |
| 2 | Desulfurized naphtha | 1,190 |
| 3 | Desulfurized heavy naphtha | 1000 |
| 4 | Desulfurized light naphtha | 190 |
| 5 | Reformate | 850 |
| 6 | BTX | 786 |
| 7 | Aromatic bottoms stream C9+ | 153 |
| 8 | Diesel | 1000 |
| 9 | Desulfurized diesel | 987 |
| 13 | Light olefins | 102 |
| 14 | Pyrolysis gasoline | 36 |
| 15 | Pyrolysis fuel oil | 9 |

Inventive Example 7—Overall Material Balance

The inventive example followed the process flow diagram shown in FIG. 1. Results of the material balance are shown in Table 6 and the stream numbers correspond to the numerals in the figure. The operating conditions for each step are given in examples 1 through 5.

TABLE 7

| Stream No. | Stream Name | Kg |
|---|---|---|
| 1 | Full range naphtha | 1,200 |
| 2 | Desulfurized naphtha | 1,190 |
| 3 | Desulfurized heavy naphtha | 1000 |
| 4 | Desulfurized light naphtha | 190 |
| 5 | Reformate | 1,020 |
| 6 | BTX | 1,133 |
| 7 | Aromatic bottoms stream C9+ | 208 |
| 8 | Diesel | 1,000 |
| 9 | Desulfurized diesel | 987 |
| 10 | Hydrocrackate | 466 |
| 11 | Fuels | 2 |
| 12 | LPG (C2-C4) | 413 |
| 13 | Light olefins | 355 |
| 14 | Pyrolysis gasoline | 64 |
| 15 | Pyrolysis fuel oil | 15 |

As is shown in Examples 6 and 7, the inventive example provides 347 kg more BTX, 253 kg more light olefins, and 28 kg more gasoline than the comparative example, using the same initial feed of 1,000 kg diesel and 1,200 kg naphtha.

It is also noted that recitations herein of "at least one" component, element, etc., should not be used to create an inference that the alternative use of the articles "a" or "an" should be limited to a single component, element, etc.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A process for the upgrading of petroleum products, the process comprising:

subjecting a diesel feed to a hydrocracking process, thereby producing a hydrocrackate fraction, wherein at least 90 wt. % of hydrocarbon molecules in the diesel feed have between 12 and 22 carbon atoms per molecule;

separating a naphtha feed into a light naphtha stream and a heavy naphtha stream, the heavy naphtha stream having a higher average number of carbons per molecule than the light naphtha stream;

subjecting the hydrocrackate fraction and the heavy naphtha stream to a catalytic reforming process, thereby producing a reformate; and recovering aromatics from the reformate via an aromatic recovery complex, wherein the heavy naphtha stream is subjected to the catalytic reforming process in conjunction with the hydrocrackate fraction, and wherein the heavy naphtha stream is sent directly to the catalytic reforming process after being separated from the naphtha feed.

2. The process of claim 1, wherein the diesel feed is subjected to a hydrodesulphurization process prior to the hydrocracking process.

3. The process of claim 1, wherein the hydrocrackate fraction has a boiling point of less than or equal to 180° C.

4. The process of claim 1, wherein recovering aromatics from the reformate comprises producing a benzene/toluene/xylene (BTX) stream and an aromatic bottoms stream.

5. The process of claim 4, wherein the aromatic bottoms stream is subjected to the hydrocracking process in conjunction with the diesel feed.

6. The process of claim 1, wherein subjecting the diesel feed to the hydrocracking process further comprises producing a light gas fraction and the light gas fraction is subjected to a steam cracking process.

7. The process of claim 1, wherein subjecting the diesel feed to the hydrocracking process further comprises producing a fuel fraction and a mass flow rate of the fuel fraction is less than 10 wt. % of a mass flow rate of the diesel feed.

8. The process of claim 1, wherein the naphtha feed is subjected to a hydrodesulphurization process.

9. The process of claim 1, wherein:

hydrocracking the diesel feed further comprises producing a light gas fraction, the light gas fraction is subjected to a steam cracking process, and the light naphtha stream is subjected to a steam cracking process in conjunction with the light gas fraction.

10. The process of claim 1, wherein:

recovering aromatics from the reformate comprises producing a BTX stream and an aromatic bottoms stream, and a mass flow rate of the BTX stream is at least 70% of a mass flow rate of the naphtha feed.

11. A method of producing aromatics comprising:

introducing a diesel feed to a hydrocracking unit to produce a hydrocrackate fraction, wherein at least 90 wt. % of hydrocarbon molecules in the diesel feed have between 12 and 22 carbon atoms per molecule;

separating, by a naphtha splitter, a naphtha feed into a light naphtha stream and a heavy naphtha stream, the heavy naphtha stream having a higher average number of carbons per molecule than the light naphtha stream;

passing the hydrocrackate fraction and the heavy naphtha stream to a catalytic reforming unit to produce a reformate; and passing the reformate to an aromatic recovery complex to produce an aromatic fraction, wherein the heavy naphtha stream and hydrocrackate fraction are reformed simultaneously in the catalytic reforming unit, and wherein the heavy naphtha stream is passed directly to the catalytic reforming unit after being separated from the naphtha feed.

12. The method of claim 11, wherein the diesel feed is subjected to a hydrodesulphurization process prior to the hydrocracking process.

13. The method of claim 11, wherein the hydrocrackate fraction has a boiling point of less than or equal to 180° C.

14. The method of claim 11, wherein the aromatic fraction comprises benzene/toluene/xylene (BTX) stream and an aromatic bottoms stream, wherein the aromatic bottoms stream is subjected to the hydrocracking process in conjunction with the diesel feed.

15. The method of claim 11, wherein the hydrocracking unit further produces a light gas fraction and a fuel fraction, wherein the light gas fraction is subjected to a steam cracking process, and wherein a mass flow rate of the fuel fraction is less than 10 wt. % of a mass flow rate of the diesel feed.

16. The method of claim 11, wherein:

the hydrocracking unit further produces a light gas fraction that is subjected to a steam cracking process, and the light naphtha stream is subjected to a steam cracking process in conjunction with the light gas fraction.

17. The process of claim 1, wherein the naphtha feed is an overhead liquid distillate from a first crude oil distillation unit within a refinery.

18. The method of claim 11, wherein the naphtha feed is an overhead liquid distillate from a first crude oil distillation unit within a refinery.

* * * * *